US011766679B2

(12) United States Patent
Peng et al.

(10) Patent No.: US 11,766,679 B2
(45) Date of Patent: Sep. 26, 2023

(54) FLOW SELF-ADJUSTING TYPE MINE DIAMETER GRADING APPARATUS APPLIED TO TAILINGS RECOVERY

(71) Applicant: JIANGSU UNIVERSITY, Zhenjiang (CN)

(72) Inventors: Guangjie Peng, Zhenjiang (CN); Shiming Hong, Zhenjiang (CN); Hao Chang, Zhenjiang (CN)

(73) Assignee: JIANGSU UNIVERSITY, Zhenjiang (CN)

( * ) Notice: Subject to any disclaimer, the term of this patent is extended or adjusted under 35 U.S.C. 154(b) by 0 days.

(21) Appl. No.: 18/023,732

(22) PCT Filed: Nov. 17, 2021

(86) PCT No.: PCT/CN2021/131121

§ 371 (c)(1),
(2) Date: Feb. 28, 2023

(87) PCT Pub. No.: WO2023/077560

PCT Pub. Date: May 11, 2023

(65) Prior Publication Data

US 2023/0241624 A1 Aug. 3, 2023

(30) Foreign Application Priority Data

Nov. 5, 2021 (CN) ..... 202111304611.1

(51) Int. Cl.
*B03B 11/00* (2006.01)
*B03B 5/48* (2006.01)

(52) U.S. Cl.
CPC ..... *B03B 11/00* (2013.01); *B03B 5/48* (2013.01)

(58) Field of Classification Search
CPC ..... B03B 5/48; B03B 11/00
USPC ..... 261/123
See application file for complete search history.

(56) References Cited

FOREIGN PATENT DOCUMENTS

| | | | | |
|---|---|---|---|---|
| CN | 87206538 | U | | 12/1987 |
| CN | 101370600 | A | | 2/2009 |
| CN | 201777915 | U | | 3/2011 |
| CN | 108296161 | A | | 7/2018 |
| CN | 109012988 | A | | 12/2018 |
| CN | 211303400 | U | * | 8/2020 |

(Continued)

*Primary Examiner* — Terrell H Matthews
(74) *Attorney, Agent, or Firm* — Bayramoglu Law Offices LLC

(57) ABSTRACT

A flow self-adjusting type mine diameter grading apparatus applied to tailings recovery includes a driving device, a tailings conveying device, a flow regulating device, and a mine diameter grading device arranged in sequence according to working procedures. A motor of the driving device is configured to drive an axial flow impeller and a spiral concentrating wheel to do work through a main shaft connected with the motor. The tailing conveying device includes a tailing water main pipe, a tailing water pipe, an ore blowing pipe, an ore suction pipe, an ore conveying main pipe and ore conveying branch pipes. A flow regulating valve of the flow regulating device is configured to rotate along with the main shaft and move up and down according to change of a rotational speed. The mine diameter grading device includes first-level to fifth-level mine diameter grading plates and first-level to fifth-level mine diameter storage bins.

10 Claims, 2 Drawing Sheets

(56) References Cited

FOREIGN PATENT DOCUMENTS

| | | | | | |
|---|---|---|---|---|---|
| CN | 211303400 | U | | 8/2020 | |
| CN | 211865734 | U | | 11/2020 | |
| CN | 114192272 | A | * | 3/2022 | |
| GB | 1352477 | A | * | 5/1974 | ..... B07B 11/02 |
| GB | 1352477 | A | | 5/1974 | |
| WO | WO-2023077560 | A1 | * | 5/2023 | |

* cited by examiner

FLOW SELF-ADJUSTING TYPE MINE DIAMETER GRADING APPARATUS APPLIED TO TAILINGS RECOVERY

CROSS REFERENCE TO THE RELATED APPLICATIONS

This application is the national phase entry of International Application No. PCT/CN2021/131121, filed on Nov. 17, 2021, which is based upon and claims priority to Chinese Patent Application No. 202111304611.1, filed on Nov. 5, 2021, the entire contents of which are incorporated herein by reference.

TECHNICAL FIELD

The present disclosure relates to tailings recovery, and particularly to a flow self-adjusting type mine diameter grading apparatus applied to tailings recovery.

BACKGROUND

Slurry pumps are widely used in the fields such as tailings transportation, dredging and sand mining. In the beneficiation process, most of the tailings after the flotation process are directly transported to the tailings pond by the slurry pump without being treated. The tailings contain a mixture of ore particles of different sizes and different particle diameters. Such ore particles of different diameters are difficult to screen in the later stage, leading to high treatment costs and a waste of tailings resources.

SUMMARY

To overcome the drawbacks in the prior art, the present disclosure provides a flow self-adjusting type mine diameter grading apparatus applied to tailings recovery. The apparatus is driven by only one motor, is easy to operate and convenient to transport, can quickly complete the processes of tailings recovery and mine diameter grading, and can automatically adjust the flow according to the change of the rotational speed, with high operational efficiency and low loss of energy consumption.

The above technical object of the present disclosure is attained with the following technical means.

A flow self-adjusting type mine diameter grading apparatus applied to tailings recovery is provided, including a driving device, a tailings conveying device, a flow regulating device, and a mine diameter grading device arranged in sequence according to working procedures.

The driving device includes a motor, and the motor is configured to drive an axial flow impeller and a spiral concentrating wheel to do work through a main shaft connected with the motor.

A tailing water main pipe is arranged above the tailings conveying device. The axial flow impeller is arranged inside the tailing water main pipe. An upper part of the tailing water main pipe is divided into a left tailing water pipe and a right tailing water pipe. The left tailing water pipe is arranged vertically downward via a 90° elbow after horizontally extending a distance. A vertical segment of the left tailing water pipe includes a shrinking segment. A left ore blowing pipe is arranged below the shrinking segment. The left ore blowing pipe enters a left secondary ore suction pipe horizontally through a 90° elbow after vertically extending a distance. A part of the left ore blowing pipe located inside the left secondary ore suction pipe is a shrinking segment. A left nozzle is arranged at an end of a horizontal segment of the left ore blowing pipe. A left main ore suction pipe is arranged below the left secondary ore suction pipe. The left secondary ore suction pipe is in communication with the left main ore suction pipe. The right tailing water pipe is arranged vertically downward via a 90° elbow after horizontally extending a distance. A vertical segment of the right tailing water pipe includes a shrinking segment. A right ore blowing pipe is arranged below the shrinking segment. The right ore blowing pipe enters a right secondary ore suction pipe horizontally through a 90° elbow after vertically extending a distance. A part of the right ore blowing pipe located inside the right secondary ore suction pipe is a shrinking segment. A right nozzle is arranged at an end of a horizontal segment of the right ore blowing pipe. A right main ore suction pipe is arranged below the right secondary ore suction pipe. The right secondary ore suction pipe is in communication with the right main ore suction pipe. A separation baffle is arranged between the left ore suction pipes and the right ore suction pipes.

An ore conveying main pipe connected to the left and right ore suction pipes is arranged above the separation baffle. Lower ore conveying branch pipes are arranged above the ore conveying main pipe. An ore separating blade is arranged at the connection between the ore conveying main pipe and the lower ore conveying branch pipes. A top of each of the lower ore conveying branch pipes is connected to a first-level mine diameter storage bin. The first-level mine diameter storage bin is a hollow cylinder.

A disturbance baffle is connected to an inner upper wall surface of the first-level mine diameter storage bin. A second-level mine diameter storage bin is arranged on an inner side of the first-level mine diameter storage bin. A first-level mine diameter grading plate is arranged between the first-level mine diameter storage bin and the second-level mine diameter storage bin. A flow regulating valve connected to the main shaft is arranged inside the second-level mine diameter storage bin.

A hinge is arranged at the connection between the flow regulating valve and the main shaft. A connecting rod is arranged at the hinge. Two swing balls are arranged on an outer side of the connecting rod. A connecting spring is arranged between the swing balls. The connecting spring is in a compressed state in an initial state. A bearing is arranged below and connected to the hinge. The bearing is a tapered roller bearing. An upper control valve and a lower control valve are arranged in sequence below the bearing. The upper control valve and the lower control valve are connected through a control valve connecting rod. The upper control valve and the lower control valve are supported by a cross connecting rod. In the initial state, an end surface of a bottom of the upper control valve is at the same horizontal level as an inner bottom surface of the first-level mine diameter storage bin, i.e., the upper control valve is in a fully closed state.

A second-level mine diameter grading plate is arranged above the flow regulating valve. A third-level mine diameter storage bin is arranged above the second-level mine diameter grading plate. The second-level mine diameter grading plate is embedded below a bin body of the third-level mine diameter storage bin. The spiral concentrating wheel connected with the main shaft is arranged inside the third-level mine diameter storage bin. A fourth-level mine diameter storage bin is arranged on and connected to an outer side of the third-level mine diameter storage bin. A third-level mine diameter grading plate is arranged between the third-level mine diameter storage bin and the fourth-level mine diameter storage bin. The third-level mine diameter grading plate is embedded in a bin body of the third-level mine diameter storage bin. Upper ore conveying branch pipes are connected above an outer side of the fourth-level mine diameter storage bin. A top of each of the upper ore conveying branch pipes is connected with a fifth-level mine diameter storage bin. A fourth-level mine diameter grading plate is arranged between the upper ore conveying branch pipes and the fifth-level mine diameter storage bin. The fourth-level mine diameter grading plate is embedded in a bin body of the fifth-level mine diameter storage bin. A fifth-level mine diameter grading plate is arranged at a top of the fifth-level mine diameter storage bin.

Preferably, the shrinking segment included in the vertical segment of the left tailing water pipe has a shrinking angle of 30°, a ratio between diameters of the left tailing water pipe and the left ore blowing pipe is 2:1, the shrinking segment of the left ore blowing pipe located inside the left secondary ore suction pipe has a shrinking angle of 15°.

Preferably, the shrinking segment included in the vertical segment of the right tailing water pipe has a shrinking angle of 30°, a ratio between diameters of the right tailing water pipe and the right ore blowing pipe is 2:1, and the shrinking segment of the right ore blowing pipe located inside the right secondary ore suction pipe has a shrinking angle of 15°.

Preferably, four lower ore conveying branch pipes are evenly distributed along a circumferential direction in the form of a hollow circular ring, an angle between every two lower ore conveying branch pipes is 90°, and a ratio between diameters of the ore conveying main pipe and the lower ore conveying branch pipes is 4:1.

Preferably, a bearing is arranged below and connected to the hinge, and the bearing is a tapered roller bearing.

Preferably, a height of the upper control valve, a height of the lower control valve and a distance between the end surface of the bottom of the upper control valve and an end surface of a top of the lower control valve are equal, and are equal to a length of the first-level mine diameter grading plate in a vertical direction.

Preferably, four third-level mine diameter grading plates are evenly distributed along a circumferential direction, and are embedded in the bin body of the third-level mine diameter storage bin, forming a square when viewed from the front.

Preferably, four upper ore conveying branch pipes are evenly distributed in a circumferential direction in the form of a hollow circular ring, an angle between every two upper ore conveying branch pipes is 90°, and a ratio between diameters of the ore conveying main pipe and the upper ore conveying branch pipes is 4:1.

Preferably, four fourth-level mine diameter grading plates are evenly distributed along a circumferential direction, and are embedded in the bin body of the fifth-level mine diameter storage bin, forming a square when viewed from the front.

Preferably, the spiral concentrating wheel and the ore separating blade are made of an aluminum alloy material, the axial flow impeller, the first-level to fifth-level mine diameter storage bins, the ore blowing pipes, the ore suction pipes, and the tailing water pipes are all integrally formed of cast iron, the flow regulating valve is formed by carbon steel, the separation baffle is made of a rubber material, and the first-level to fifth-level mine diameter grading plates are made of a graphene material.

The present disclosure has the following beneficial effects.

1. The present disclosure adopts the method of forming local low pressure by producing a high-speed jet flow at the nozzle, so that the tailings slurry enters the ore suction pipe under the action of pressure difference. Compared with the direct pumping of tailings using a slurry pump, the present disclosure can significantly improve the efficiency of ore suction and reduce the load on the slurry pump.

2. The present disclosure adopts the flow regulating valve structure. During the mine diameter grading process, the flow regulating valve can move vertically up and down in the second-level mine diameter storage bin according to the change of the rotational speed, and automatically adjust the flow of the tailings slurry entering the mine diameter grading device, thereby ensuring a stable mine diameter grading process and significantly improving the efficiency of mine diameter grading.

3. The present disclosure adopts an open circulation structure to make full use of the effluent energy of the tailing water, and adopts the shrinkage structures of the vertical segment of the tailing water pipe and the horizontal segment of the ore blowing pipe so that the tailing water is accelerated twice before entering the nozzle, thereby effectively improving the efficiency of ore suction and ore blowing.

4. The present disclosure adopts the spiral concentrating wheel structure, which can mix the tailings ore particles in the third-level mine diameter storage bin while pumping the tailings slurry, to increase the disturbance in the storage bin and evenly disperse the ore particles of different particle sizes, thereby improving the efficiency of mine diameter grading.

5. The present disclosure adopts the separation baffle structure, which reduces the impact loss caused by the high-speed effluent tailing water on the left and right sides colliding with each other. In addition, the separation baffle is made of a rubber material, which is easy to replace after wear.

6. The present disclosure adopts a five-level mine diameter grading structure to separate the ore particles of different mine diameter levels, thereby effectively utilizing the coarse ore and fine ore, and reducing the waste of tailings resources caused when coarse and fine tailings are not separated from each other.

Figure 1:
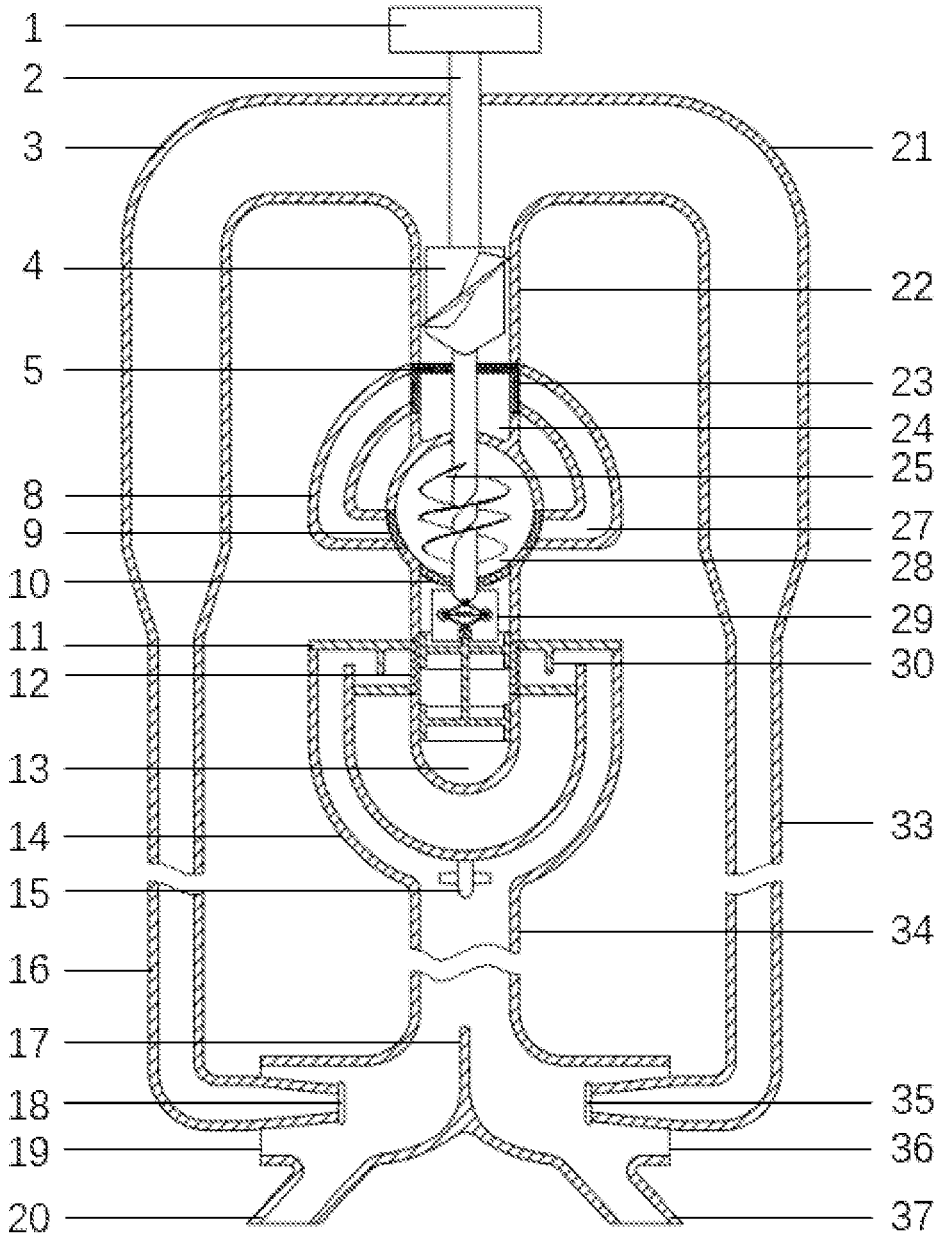
FIG. 1 is a schematic structural diagram of a flow self-adjusting type mine diameter grading apparatus applied to tailings recovery according to the present disclosure.
Figure 2:
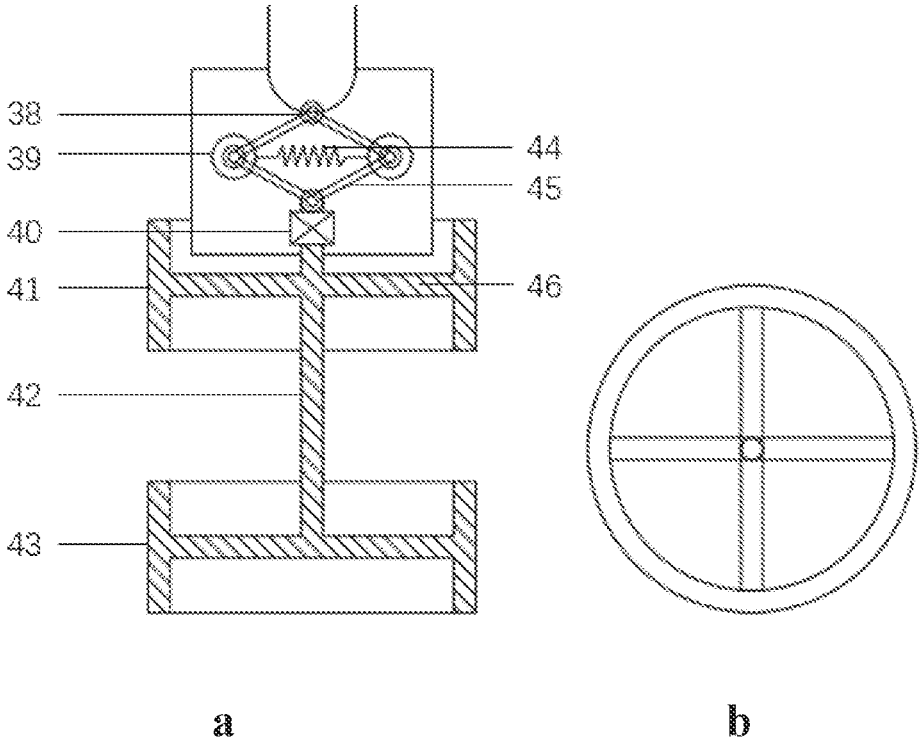
FIG. 2 is a schematic structural diagram of a flow regulating valve according to the present disclosure, where a is a cross-sectional front view, and b is a top view.
Figure 3:
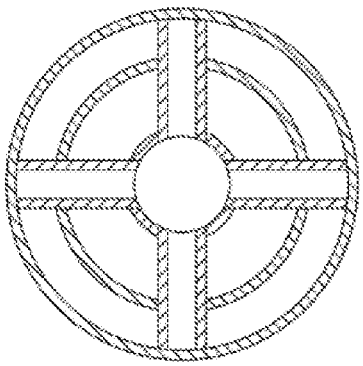
FIG. 3 is a schematic structural diagram of ore conveying branch pipes according to the present disclosure.

In the drawings: 1—motor; 2—main shaft; 3—left tailing water pipe; 4—axial flow impeller; 5—fifth-level mine diameter grading plate; 8—upper ore conveying branch pipe; 9—third-level mine diameter grading plate; 10—second-level mine diameter grading plate; 11—first-level mine diameter storage bin; 12—first-level mine diameter grading plate; 13—second-level mine diameter storage bin; 14—lower ore conveying branch pipe; 15—ore separating blade; 16—left ore blowing pipe; 17—separation baffle; 18—left nozzle; 19—left secondary ore suction pipe; 20 left main ore suction pipe; 21—right tailing water pipe; 22—tailing water main pipe; 23—fourth-level mine diameter grading plate; 24—fifth-level mine diameter storage bin; 25—spiral concentrating wheel; 27—fourth-level mine diameter storage bin; 28—third-level mine diameter storage bin; 29—flow regulating valve; 30—disturbance baffle; 33—right ore blowing pipe; 34—ore conveying main pipe; 35—right nozzle; 36—right secondary ore suction pipe; 37—right main ore suction pipe; 38—hinge; 39—swing ball; 40—bearing; 41—upper control valve; 42—control valve connecting rod; 43—lower control valve; 44—connecting spring; 45—connecting rod; 46—cross connecting rod.

DETAILED DESCRIPTION OF THE EMBODIMENTS

The present disclosure will be further described in detail below with reference to drawings and embodiments, but the protection scope of the present disclosure is not limited thereto.

As shown in FIG. 1, a flow self-adjusting type mine diameter grading apparatus applied to tailings recovery according to the present disclosure includes a driving device, a tailings conveying device, a flow regulating device, and a mine diameter grading device arranged in sequence according to working procedures.

The driving device includes a motor 1. The motor 1 is configured to drive an axial flow impeller 4 and a spiral concentrating wheel 25 to do work through a main shaft 2 connected with the motor.

A tailing water main pipe 22 is arranged above the tailings conveying device. The axial flow impeller 4 is arranged inside the tailing water main pipe 22. An upper part of the tailing water main pipe 22 is divided into a left tailing water pipe 3 and a right tailing water pipe 21. The left tailing water pipe 3 is arranged vertically downward via a 90° elbow after horizontally extending a distance. A vertical segment of the left tailing water pipe 3 includes a shrinking segment having a shrinking angle of 30°. A left ore blowing pipe 16 is arranged below the shrinking segment. A ratio between diameters of the left tailing water pipe 3 and the left ore blowing pipe 16 is 2:1. The left ore blowing pipe 16 enters a left secondary ore suction pipe 19 horizontally through a 90° elbow after vertically extending a distance. A part of the left ore blowing pipe 16 located inside the left secondary ore suction pipe 19 is a shrinking segment having a shrinking angle of 15°. A left nozzle 18 is arranged at an end of a horizontal segment of the left ore blowing pipe 16. A left main ore suction pipe 20 is arranged below the left secondary ore suction pipe 19. The left secondary ore suction pipe 19 is in communication with the left main ore suction pipe 20. The right tailing water pipe 21 is arranged vertically downward via a 90° elbow after horizontally extending a distance. A vertical segment of the right tailing water pipe 21 includes a shrinking segment having a shrinking angle of 30°. A right ore blowing pipe 33 is arranged below the shrinking segment. A ratio between diameters of the right tailing water pipe 21 and the right ore blowing pipe 33 is 2:1. The right ore blowing pipe 33 enters a right secondary ore suction pipe 36 horizontally through a 90° elbow after vertically extending a distance. A part of the right ore blowing pipe 33 located inside the right secondary ore suction pipe 36 is a shrinking segment having a shrinking angle of 15°. A right nozzle 35 is arranged at an end of a horizontal segment of the right ore blowing pipe 33. A right main ore suction pipe 37 is arranged below the right secondary ore suction pipe 36. The right secondary ore suction pipe 36 is in communication with the right main ore suction pipe 37. A separation baffle 17 is arranged between the left ore suction pipes and the right ore suction pipes.

An ore conveying main pipe 34 connected to the left and right ore suction pipes is arranged above the separation baffle 17. Lower ore conveying branch pipes 14 are arranged above the ore conveying main pipe 34. Four lower ore conveying branch pipes 14 are evenly distributed along a circumferential direction in the form of a hollow circular ring, and an angle between every two lower ore conveying branch pipes 14 is 90°. A ratio between diameters of the ore conveying main pipe 34 and the lower ore conveying branch pipes 14 is 4:1. An ore separating blade 15 is arranged at the connection between the ore conveying main pipe 34 and the lower ore conveying branch pipes 14. A top of each of the lower ore conveying branch pipes 14 is connected to a first-level mine diameter storage bin 11. The first-level mine diameter storage bin 11 is a hollow cylinder.

A disturbance baffle 30 is connected to an inner upper wall surface of the first-level mine diameter storage bin 11. The cross section of the disturbance baffle 30 is a circular ring. A second-level mine diameter storage bin 13 is arranged on an inner side of the first-level mine diameter storage bin 11. A first-level mine diameter grading plate 12 is arranged between the first-level mine diameter storage bin 11 and the second-level mine diameter storage bin 13. The first-level mine diameter grading plate 12 is in the shape of a circular pipe. A bottom of the second-level mine diameter storage bin 13 is in the shape of a hollow hemisphere, and an upper part of the second-level mine diameter storage bin 13 is in the shape of a hollow cylinder. A flow regulating valve 29 connected to the main shaft 2 is arranged inside the second-level mine diameter storage bin 13. A hinge 38 is arranged at the connection between the flow regulating valve 29 and the main shaft 2. A connecting rod 45 is arranged at the hinge 38. Two swing balls 39 are arranged on an outer side of the connecting rod 45. A connecting spring 44 is arranged between the swing balls 39. The connecting spring 44 is in a compressed state in an initial state. A bearing 40 is arranged below and connected to the hinge 38. The bearing 40 is a tapered roller bearing. An upper control valve 41 and a lower control valve 43 are arranged in sequence below the bearing 40. The upper control valve 41 and the lower control valve 43 are connected through a control valve connecting rod 42. The upper control valve 41 and the lower control valve 43 are supported by a cross connecting rod 46. A height of the upper control valve 41, a height of the lower control valve 43 and a distance between the end surface of the bottom of the upper control valve 41 and an end surface of a top of the lower control valve 43 are equal, and are equal to a length of the first-level mine diameter grading plate 12 in a vertical direction. In the initial state, an end surface of a bottom of the upper control valve 41 is at the same horizontal level as an inner bottom surface of the first-level mine diameter storage bin 11, i.e., the upper control valve 41 is in a fully closed state.

A second-level mine diameter grading plate 10 is arranged above the flow regulating valve 29. The second-level mine diameter grading plate 10 is embedded below a bin body of a third-level mine diameter storage bin 28. The third-level mine diameter storage bin 28 is in the shape of a hollow sphere. The spiral concentrating wheel 25 connected with the main shaft 2 is arranged inside the third-level mine diameter storage bin 28. A fourth-level mine diameter storage bin 27 is arranged on and connected to an outer side of the third-level mine diameter storage bin 28. A third-level mine diameter grading plate 9 is arranged between the third-level mine diameter storage bin 28 and the fourth-level mine diameter storage bin 27. Four third-level mine diameter grading plates 9 are evenly distributed along a circumferential direction, and are embedded in the bin body of the third-level mine diameter storage bin 28, forming a square when viewed from the front. Upper ore conveying branch pipes 8 are connected to an outer upper side of the fourth-level mine diameter storage bin 27. Four upper ore conveying branch pipes 8 are evenly distributed in a circumferential direction in the form of a hollow circular ring, and an angle between every two upper ore conveying branch pipes 8 is 90°. A ratio between diameters of the ore conveying main pipe 34 and the upper ore conveying branch pipes 8 is 4:1. A top of each of the upper ore conveying branch pipes 8 is connected with a fifth-level mine diameter storage bin 24. The fifth-level mine diameter storage bin 24 is in the shape of a hollow cylinder. A fourth-level mine diameter grading plate 23 is arranged between the upper ore conveying branch pipes 8 and the fifth-level mine diameter storage bin 24. Four fourth-level mine diameter grading plates 23 are evenly distributed along a circumferential direction, and are embedded in a bin body of the fifth-level mine diameter storage bin 24, forming a square when viewed from the front. A fifth-level mine diameter grading plate 5 is arranged at a top of the fifth-level mine diameter storage bin 24.

The spiral concentrating wheel 25 and the ore separating blade 15 are made of an aluminum alloy material. The axial flow impeller 4, the first-level to fifth-level mine diameter storage bins, the ore blowing pipes, the ore suction pipes, and the tailing water pipes are all integrally formed of cast iron. The flow regulating valve 29 is formed by carbon steel. The separation baffle 17 is made of a rubber material. The first-level to fifth-level mine diameter grading plates are made of a graphene material.

The operation process of the present disclosure is as follows.

The motor 1 drives the axial flow impeller 4 and the spiral concentrating wheel 25 to do work through the main shaft 2 connected with the motor. As the rotational speed increases, the flow regulating valve 29 connected to the main shaft 2 starts to operate, the swing balls 39 start to move outward under a rotational centrifugal force, the pressure received by the connecting spring 44 during the initial state gradually decreases, the connecting rod 45 is driven by the swing balls 39 to move outward, the angle between the upper and lower connecting rods 45 gradually decreases, and the angle between the left and right connecting rods 45 gradually increases. In this case, the hinge 38 moves upward according to its mechanical structure, and drives the upper control valve 41 connected to the bearing 40 to move upward. The distance between the end surface of the bottom of the upper control valve 41 and the inner bottom surface of the first-level mine diameter storage bin 11 gradually increases, the valve is opened, and the device starts to operate at this time, so that air in the mine diameter storage bins is exhausted, and ore pulp enters the tailing water main pipe 22 through the mine diameter grading device.

Tailing water that enters the tailing water main pipe 22 is pumped by the axial flow impeller 4 to move upward, and then enters the left and right tailing water pipes respectively at the top. Taking the left tailing water pipe 3 as an example, the tailing water is pumped by the axial flow impeller 4 to flow horizontally by a distance, then vertically moves downward via the 90° elbow, flows through the vertical shrinking segment, and enters the left ore blowing pipe 16. At this time, the tailing water is accelerated for the first time. The tailing water continues to move downward in the left ore blowing pipe 16, flows through the 90° elbow, and then horizontally flows into the left secondary ore suction pipe 19. After being accelerated through the horizontal shrinking segment, the tailing water enters the left nozzle 18. A high-speed jet flow from the left nozzle 18 enters the left ore suction pipe. Due to the local low pressure formed by the high-speed jet flow of the left nozzle 18, the tailings slurry is sucked into the left ore suction pipe from the left main ore suction pipe 20 and the left secondary ore suction pipe 19 respectively. The operating principles of the right tailing water pipe 21, the right ore blowing pipe 33, the right nozzle 35, the right main ore suction pipe 37 and the right secondary ore suction pipe 36 are the same as those of their left counterparts. The tailings slurry on the left and right sides are guided by the separation baffle 17 to converge at a position above the separation baffle 17 and enter the ore conveying main pipe 34, and the mine diameter grading process begins.

The tailings slurry entering the ore conveying main pipe 34 moves upward and impacts the ore separating blade 15 at the connection between the ore conveying main pipe 34 and the lower ore conveying branch pipes 14. Under the action of the ore separating blade 15, the tailings slurry is mixed and stirred, and evenly enters the lower ore conveying branch pipes 14 from four directions. The tailings slurry entering the lower ore conveying branch pipes 14 continues to move upward along the arc-shaped pipes, and enters the first-level mine diameter storage bin 11. The tailings slurry entering the first-level mine diameter storage bin 11 moves toward the center. When passing through the disturbance baffle 30, the tailings slurry is disturbed and mixed, and ore particles are evenly dispersed. With the separation by the first-level mine diameter grading plate 12, first-level ore particles of a particle size larger than a pore diameter of the first-level mine diameter grading plate 12 are blocked in the first-level mine diameter storage bin 11. Tailings of a particle size smaller than the pore diameter of the first-level mine diameter grading plate 12 pass through the first-level mine diameter grading plate 12 and enter the second-level mine diameter storage bin 13. During the upward movement, second-level ore particles of a particle size larger than a pore diameter of the second-level mine diameter grading plate 10 are blocked in the second-level mine diameter storage bin 13. The tailings of a particle size smaller than the pore diameter of the second-level mine diameter grading plate 10 pass through the second-level mine diameter grading plate 10 and enter the third-level mine diameter storage bin 28. As the spiral concentrating wheel 25 rotates and does work, the tailings slurry is stirred, mixed and evenly dispersed, and at the same time, is pressurized to move radially toward the third-level mine diameter grading plate 9. With the separation by the third-level mine diameter grading plate 12, third-level ore particles of a particle size larger than a pore diameter of the third-level mine diameter grading plate 12 are blocked in the third-level mine diameter storage bin 28. The tailings of a particle size smaller than the pore diameter of the third-level mine diameter grading plate 9 pass through the second-level mine diameter grading plate 9 and enter the fourth-level mine diameter storage bin 27, and continue to move upward along the arc-shaped pipe from the upper ore conveying branch pipes 8. With the separation by the fourth-level mine diameter grading plate 23, fourth-level ore particles of a particle size larger than a pore diameter of the fourth-level mine diameter grading plate 23 are blocked in the fourth-level mine diameter storage bin 27. Tailings of a particle size smaller than the pore diameter of the fourth-level mine diameter grading plate 23 pass through the fourth-level mine diameter grading plate 23 and enter the fifth-level mine diameter storage bin 24. The tailings slurry continues to move upward. With the separation by the fifth-level mine diameter grading plate 5, fifth-level ore particles of a particle size larger than a pore diameter of the fifth-level mine diameter grading plate 5 are blocked in the third-level mine diameter storage bin 24. The tailings of a particle size smaller than the pore diameter of the fifth-level mine diameter grading plate 5 enter the tailing water main pipe 22 through the fifth-level mine diameter grading plate 5. Till now, the mine diameter grading process is completed.

As the rotational speed continues to increase, the swing balls 39 continuously move outward, the connecting spring 44 changes from a compressed state to a stretched state, the angle between the upper and lower connecting rods 45 decreases continuously, and the angle between the left and right connecting rods 45 increases continuously. The hinge 38 drives the upper control valve 41 connected with the bearing 40 to continuously move upward, until the end surface of the bottom of the upper control valve 41 is even with, i.e., at the same horizontal level as an inner bottom surface of the first-level mine diameter storage bin 11. At this time, the valve is in a fully open state, the flow reaches the maximum, and an end surface of a top of the lower control valve 43 is even with, i.e., at the same horizontal level as the inner bottom surface of the first-level mine diameter storage bin 11. When the rotational speed further increases, the flow entering the mine diameter grading device is further increased, and the grading capacity of the mine diameter grading device gradually cannot keep up with the increase of the flow. As a result, a large number of ore particles accumulate near the mine diameter grading plates, which is likely to cause blockage or other failures. In this case, the lower control valve 43 gradually moves upward with the further increase of the rotational speed, the distance between the end surface of the top of the lower control valve 43 and the inner bottom surface of the first-level mine diameter storage bin 11 gradually increases, the valve is gradually closed, and the flow entering the mine diameter grading device decreases accordingly. As such, the workload of the mine diameter grading device is reduced, and a flow self-adjusting function is realized, thereby enabling the mine diameter grading device to operate continuously and stably, and effectively improving the operational efficiency.

The embodiments are preferred embodiments of the present disclosure, but the present disclosure is not limited to the above-mentioned embodiments. Without departing from the spirit of the present disclosure, any obvious improvement, replacement or variation that can be made by the person skilled in the art belongs to the protection scope of the present disclosure.

What is claimed is:

1. A flow self-adjusting type mine diameter grading apparatus applied to tailings recovery, characterized by comprising a driving device, a tailings conveying device, a flow regulating device, and a mine diameter grading device arranged in sequence according to working procedures, wherein the driving device comprises a motor, and the motor is configured to drive an axial flow impeller and a spiral concentrating wheel to do work through a main shaft connected with the motor;

a tailing water main pipe is arranged above the tailings conveying device, the axial flow impeller is arranged inside the tailing water main pipe, an upper part of the tailing water main pipe is divided into a left tailing water pipe and a right tailing water pipe, the left tailing water pipe is arranged vertically downward via a 90° elbow after horizontally extending a distance, a vertical segment of the left tailing water pipe comprises a shrinking segment, a left ore blowing pipe is arranged below the shrinking segment, the left ore blowing pipe enters a left secondary ore suction pipe horizontally through a 90° elbow after vertically extending a distance, a part of the left ore blowing pipe located inside the left secondary ore suction pipe is a shrinking segment, a left nozzle is arranged at an end of a horizontal segment of the left ore blowing pipe, and a left main ore suction pipe is arranged below the left secondary ore suction pipe; the left secondary ore suction pipe is in communication with the left main ore suction pipe;

the right tailing water pipe is arranged vertically downward via a 90° elbow after horizontally extending a distance, a vertical segment of the right tailing water pipe comprises a shrinking segment, a right ore blowing pipe is arranged below the shrinking segment, the right ore blowing pipe enters a right secondary ore suction pipe horizontally through a 90° elbow after vertically extending a distance, a part of the right ore blowing pipe located inside the right secondary ore suction pipe is a shrinking segment, a right nozzle is arranged at an end of a horizontal segment of the right ore blowing pipe, and a right main ore suction pipe is arranged below the right secondary ore suction pipe; the right secondary ore suction pipe is in communication with the right main ore suction pipe;

a separation baffle is arranged between the left ore suction pipes and the right ore suction pipes;

an ore conveying main pipe connected to the left and right ore suction pipes is arranged above the separation baffle, lower ore conveying branch pipes are arranged above the ore conveying main pipe, an ore separating blade is arranged at the connection between the ore conveying main pipe and the lower ore conveying branch pipes, a top of each of the lower ore conveying branch pipes is connected to a first-level mine diameter storage bin, and the first-level mine diameter storage bin is a hollow cylinder;

a disturbance baffle is connected to an inner upper wall surface of the first-level mine diameter storage bin; a second-level mine diameter storage bin is arranged on an inner side of the first-level mine diameter storage bin, a first-level mine diameter grading plate is arranged between the first-level mine diameter storage bin and the second-level mine diameter storage bin, and a flow regulating valve connected to the main shaft is arranged inside the second-level mine diameter storage bin;

a second-level mine diameter grading plate is arranged above the flow regulating valve, the second-level mine diameter grading plate is embedded below a bin body of a third-level mine diameter storage bin, and the spiral concentrating wheel connected with the main shaft is arranged inside the third-level mine diameter storage bin; a fourth-level mine diameter storage bin is arranged on and connected to an outer side of the third-level mine diameter storage bin, a third-level mine diameter grading plate is arranged between the third-level mine diameter storage bin and the fourth-level mine diameter storage bin, and the third-level mine diameter grading plate is embedded in a bin body of the third-level mine diameter storage bin; upper ore conveying branch pipes are connected to an outer upper side of the fourth-level mine diameter storage bin, a top of each of the upper ore conveying branch pipes is connected with a fifth-level mine diameter storage bin, a fourth-level mine diameter grading plate is arranged between the upper ore conveying branch pipes and the fifth-level mine diameter storage bin, and the fourth-level mine diameter grading plate is embedded in a bin body of the fifth-level mine diameter storage bin; and a fifth-level mine diameter grading plate is arranged at a top of the fifth-level mine diameter storage bin.

2. The flow self-adjusting type mine diameter grading apparatus applied to tailings recovery according to claim 1, wherein the shrinking segment comprised in the vertical segment of the left tailing water pipe has a shrinking angle of 30°, a ratio between diameters of the left tailing water pipe-and the left ore blowing pipe is 2:1, the shrinking segment of the left ore blowing pipe located inside the left secondary ore suction pipe has a shrinking angle of 15°, the shrinking segment comprised in the vertical segment of the right tailing water pipe has a shrinking angle of 30°, a ratio between diameters of the right tailing water pipe and the right ore blowing pipe is 2:1, and the shrinking segment of the right ore blowing pipe located inside the right secondary ore suction pipe has a shrinking angle of 15°.

3. The flow self-adjusting type mine diameter grading apparatus applied to tailings recovery according to claim 1, characterized in that, wherein a ratio between diameters of the ore conveying main pipe and the lower ore conveying branch pipes is 4:1, and a ratio between diameters of the ore conveying main pipe and the upper ore conveying branch pipes is 4:1.

4. The flow self-adjusting type mine diameter grading apparatus applied to tailings recovery according to claim 1, characterized in that, wherein four lower ore conveying branch pipes are evenly distributed along a circumferential direction in a form of a hollow circular ring, and an angle between every two lower ore conveying branch pipes is 90°.

5. The flow self-adjusting type mine diameter grading apparatus applied to tailings recovery according to claim 1, wherein four third-level mine diameter grading plates are evenly distributed along a circumferential direction.

6. The flow self-adjusting type mine diameter grading apparatus applied to tailings recovery according to claim 1, wherein four upper ore conveying branch pipes are evenly distributed in a circumferential direction in a form of a hollow circular ring, and an angle between every two upper ore conveying branch pipes is 90°.

7. The flow self-adjusting type mine diameter grading apparatus applied to tailings recovery according to claim 1, wherein four fourth-level mine diameter grading plates are evenly distributed along a circumferential direction.

8. The flow self-adjusting type mine diameter grading apparatus applied to tailings recovery according to claim 1, wherein a hinge is arranged at a connection between the flow regulating valve and the main shaft, a connecting rod is arranged at the hinge, two swing balls are arranged on an outer side of the connecting rod, a connecting spring is arranged between the two swing balls, the connecting spring is in a compressed state in an initial state, a bearing is arranged below and connected to the hinge, the bearing is a tapered roller bearing, an upper control valve and a lower control valve are arranged in sequence below the bearing, and the upper control valve and the lower control valve are connected through a control valve connecting rod; and the upper control valve and the lower control valve are supported by a cross connecting rod, and in the initial state, an end surface of a bottom of the upper control valve is at a same horizontal level as an inner bottom surface of the first-level mine diameter storage bin, wherein the upper control valve is in a fully closed state.

9. The flow self-adjusting type mine diameter grading apparatus applied to tailings recovery according to claim 8, wherein a height of the upper control valve, a height of the lower control valve and a distance between the end surface of the bottom of the upper control valve and an end surface of a top of the lower control valve are equal, and are equal to a length of the first-level mine diameter grading plate in a vertical direction.

10. The flow self-adjusting type mine diameter grading apparatus applied to tailings recovery according to claim 1, wherein the spiral concentrating wheel and the ore separating blade are made of an aluminum alloy material, the axial flow impeller, the first-level to fifth-level mine diameter storage bins, the ore blowing pipes, the ore suction pipes, and the tailing water pipes are all integrally formed of cast iron, the flow regulating valve is formed by carbon steel, the separation baffle is made of a rubber material, and the first-level to fifth-level mine diameter grading plates are made of a graphene material.

* * * * *